United States Patent [19]

Johnson

[11] Patent Number: 4,882,567

[45] Date of Patent: Nov. 21, 1989

[54] INTRUSION DETECTION SYSTEM AND A METHOD THEREFOR

[75] Inventor: Richard A. Johnson, Pleasanton, Calif.

[73] Assignee: C & K Systems, Inc., San Jose, Calif.

[21] Appl. No.: 251,130

[22] Filed: Sep. 29, 1988

[51] Int. Cl.[4] ..... G08B 19/00

[52] U.S. Cl. ..... 340/522; 340/551; 340/565; 340/552; 340/554; 340/561; 367/93

[58] Field of Search ..... 340/522, 506, 551, 565, 340/552–561; 342/27, 28; 367/93–95

[56] References Cited

U.S. PATENT DOCUMENTS

| | | | |
|---|---|---|---|
| 4,437,089 | 3/1984 | Achard | 340/522 |
| 4,660,024 | 4/1987 | McMaster | 340/522 |
| 4,772,875 | 9/1988 | Maddox et al. | 340/522 |

*Primary Examiner*—Donnie L. Crosland
*Attorney, Agent, or Firm*—Limbach, Limbach & Sutton

[57] ABSTRACT

A dual sensing intrusion detection system includes a passive infrared radiation detection sensor that generates a first output signal in response to the detection of an intruder in the volume of space. A second detection sensor is directed to the same volume of space and generates a second output signal in response to detection of the intruder. A switch activates the second detection sensor in response to the detection of the intruder by the infrared radiation detector. Logic circuit receives the first and second output signals and produces an alarm signal in response thereto to indicate the detection of the presence of the intruder in the volume of space.

11 Claims, 6 Drawing Sheets

BLOCK DIAGRAM

INTRUSION DETECTION SYSTEM AND A METHOD THEREFOR

TECHNICAL FIELD

The present invention relates to a dual sensor intrusion detection system and more particularly to such a dual sensor intrusion detection system which consumes very little power.

BACKGROUND OF THE INVENTION

Dual sensor intrusion detection systems are well known in the art. See for example, U.S. Pat. No. 4,401,976 or 4,437,089. A typical dual sensor intrusion detection system comprises a passive infrared radiation (PIR) sensor and a microwave sensor. The sensors are directed to detect an intruder from the same volume of space. To trigger an alarm, however, both of the sensors must simultaneously detect the presence of an intruder. The use of two different types of energy sensing devices directed at the same volume of space to detect the presence of an intruder, renders such a dual sensing intrusion detection system highly intolerant to false alarms.

Increasingly, however, it is necessary to mount or install intrusion detection systems in locations where it is difficult or expensive to supply wires for electrical power or alarm conditions. Thus, the intrusion detection system must be self-contained. This requires the use of batteries.

However, it should be appreciated that with batteries, the dual sensor intrusion detection system of the prior art is constantly on. This renders the battery powered dual sensor intrusion detection system useless, because as a practical matter, batteries must be changed so frequently.

U.S. Pat. No. 4,437,089 discloses two detectors with the sensitivity of one detector increased when the other detector detects an intruder. However, that reference does not disclose or teach activating a second detector only when there is a detection by the first detector to reduce power consumption.

SUMMARY OF THE INVENTION

In the present invention, a dual sensor intrusion detection system is disclosed. The intrusion detection system comprises a first passive detecting means for detecting the presence of an intruder in a volume of space. The first passive detecting means generates a first signal in response to the detection of the intruder. A second detecting means detects the presence of the intruder in the same volume of space and generates a second signal in response to the detection of the intruder. A timer receives the first signal and generates a control signal after a period of delay. The control signal is used to activate the second detecting means by supplying power thereto. Finally, logic means receives the first and the second signals and produces the alarm signal in response thereto to indicate the detection of the intruder in the volume of space.

DETAILED DESCRIPTION OF THE DRAWINGS

Figure 1:
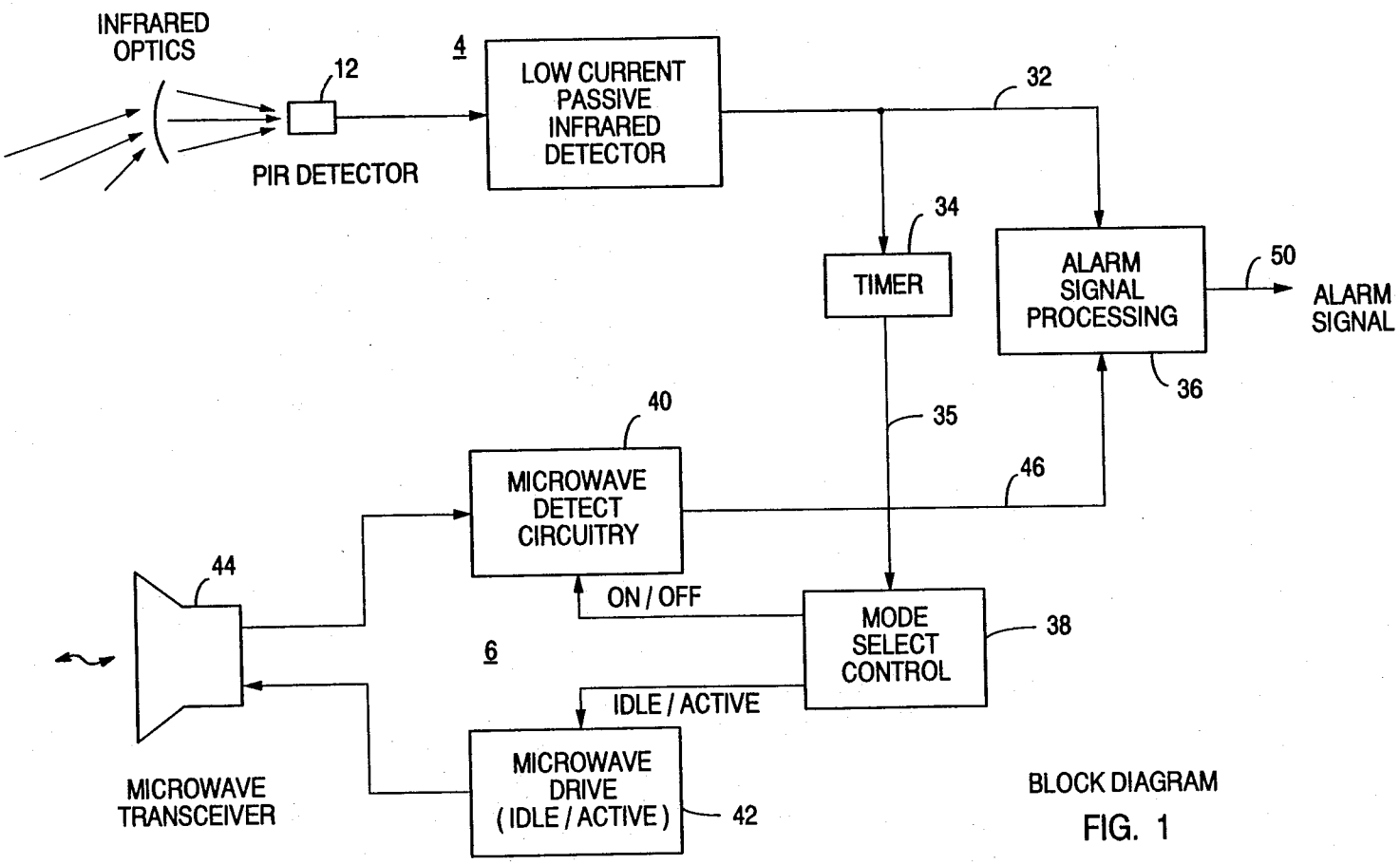
FIG. 1 is a schematic block circuit diagram of the intrusion detection system of the present invention.

Referring to FIG. 1, there is shown a schematic block diagram of the intrusion detection system 10 of the present invention. The system 10 comprises a passive infrared detector portion 4, which generates a first signal in response to the detection of an intruder in a volume of space at which the passive infrared detector 4 is directed. The system 10 also comprises a microwave sensor detector portion 6. The microwave sensor detector portion 6 emits microwave radiation and is directed at the same volume of space at which the passive infrared detector portion 4 is directed. In the event an intruder in the volume of space at which the passive infrared portion 4 and the microwave radiation portion 6 are directed is detected by both the passive infrared radiation detector 4 and the microwave radiation detector 6, then an alarm signal 50 is generated by the system 10 of the present invention.

Figure 2:
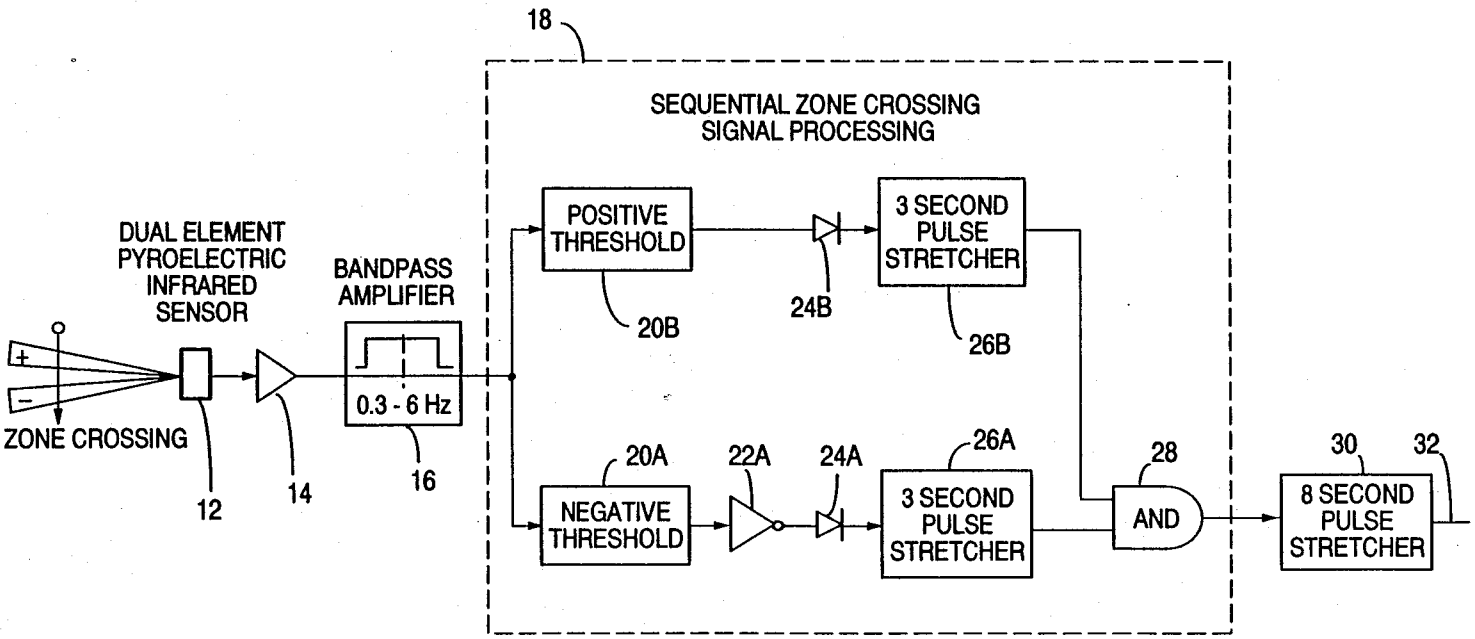
FIG. 2 is a detailed block diagram of the passive infrared detector portion of the intrusion detection system shown in FIG. 1.

The passive infrared radiation detector portion 4 is well known in the art and can be found embodied in the passive infrared radiation sensor detector portion of C&K Systems, Inc.'s Dual Tech Intrusion Device. A typical passive infrared radiation portion comprises (as shown in FIG. 2) a dual element pyro-electric infrared sensor 12 which generates a first signal in response to the detection of an intruder crossing a plurality of zones in the volume of space at which the portion 4 is directed. The first signal is then amplified by a first amplifier 14 and is passed through a band pass amplifier 16. The first signal is then processed by the processing circuit 18 which comprises a negative threshold detector circuit 20A and a positive threshold detector circuit 20B. The first signal is applied simultaneously to both the negative threshold circuit 20A and the positive threshold circuit 20B.

From the negative threshold detector circuit 20A, the signal is supplied to an invertor 22A and a diode 24A and is passed to a three-second pulse stretcher 26A. From the positive threshold detector circuit 20B, the signal is supplied to a diode 24B and a three-second pulse stretcher circuit 26B. The output of the threesecond pulse stretcher circuit 26A and the three-second pulse stretcher circuit 26B are supplied to an AND gate 28. The signal from the AND gate 28 is then supplied to an eight-second pulse stretcher circuit 30 and the output signal 32 thereof is the output of the passive infrared radiation sensor portion of the system 10 of the present invention.

The first output signal 32 is supplied to a timer circuit 34 as well as to an alarm signal processing circuit 36. The timer circuit 34 generates a control signal 35 in response to the first signal 32 supplied thereto. The control signal 35 is supplied to the mode select control circuit 38 of the microwave detection sensor 6.

The microwave detector portion 6 of the system 10 comprises a microwave generator/sensor 44, which emits microwave radiation and is directed at the same volume of space at which the infrared radiation sensor 12 is directed. A typical microwave generator/sensor 44 is a Gunn diode and a Schottky diode. The microwave is generated by a microwave driver circuit 42, which is under the direction and control of the mode select control circuit 38.

The microwave reflected from the volume of space is then collected by the same microwave sensor/generator 44 and is supplied to the microwave detect circuitry 40. The microwave detect circuitry 40 is also under the control of the mode select control circuit 38.

From the microwave detect circuit 40, a second signal 46 is then supplied to the alarm processing circuit 36. If a first signal 32 and a second signal 46 are both supplied to the alarm signal processing 36 within a predefined period of time, then an alarm signal 50 is produced by the alarm signal processing circuit 36. The alarm signal 50 is the alarm output of the system 10 of the present invention.

Figure 3A:
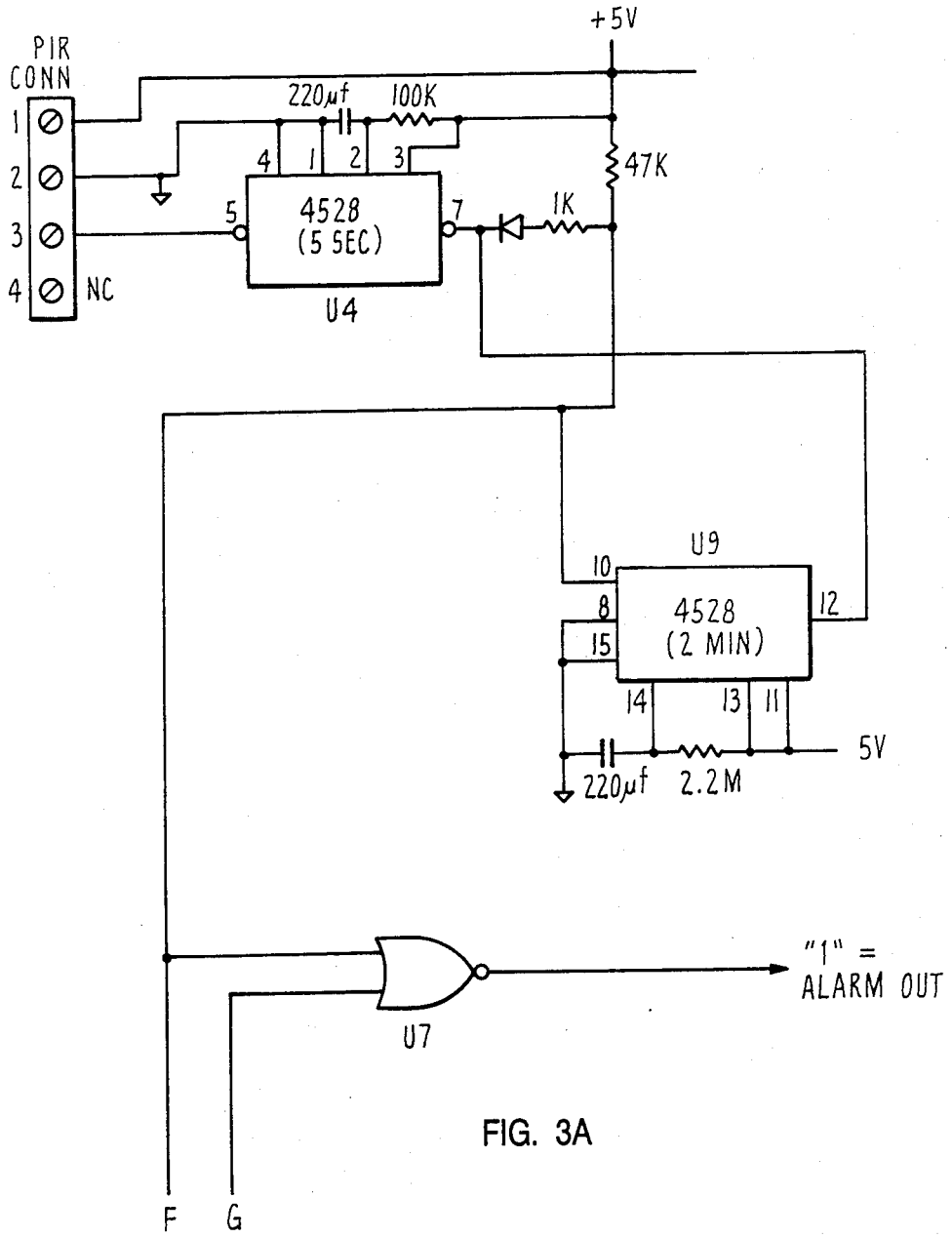
FIGS. 3A–3C are a detailed circuit diagram of the microwave detector portion of the intrusion detection system shown in FIG. 1.
Figure 3B:
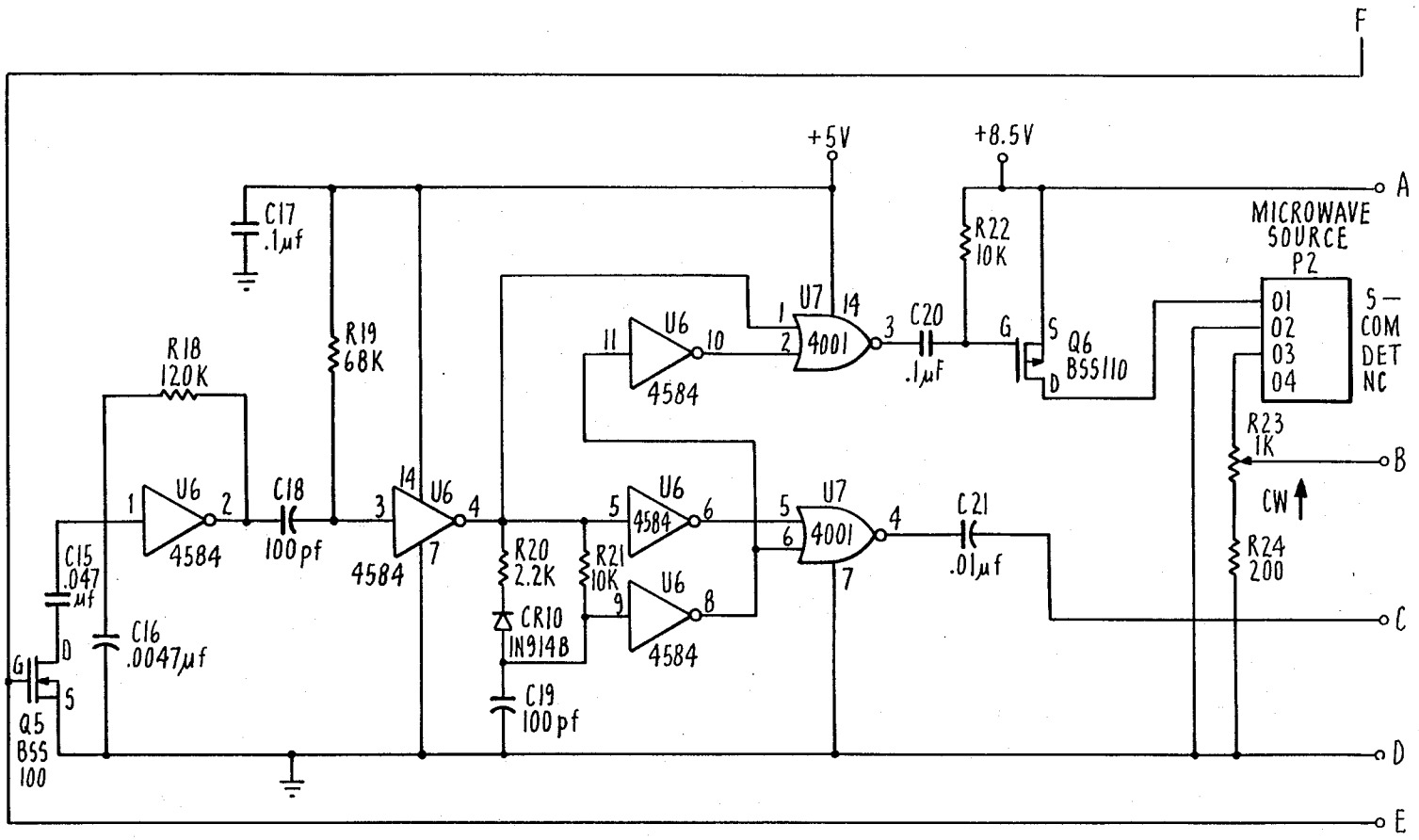
Figure 3C:
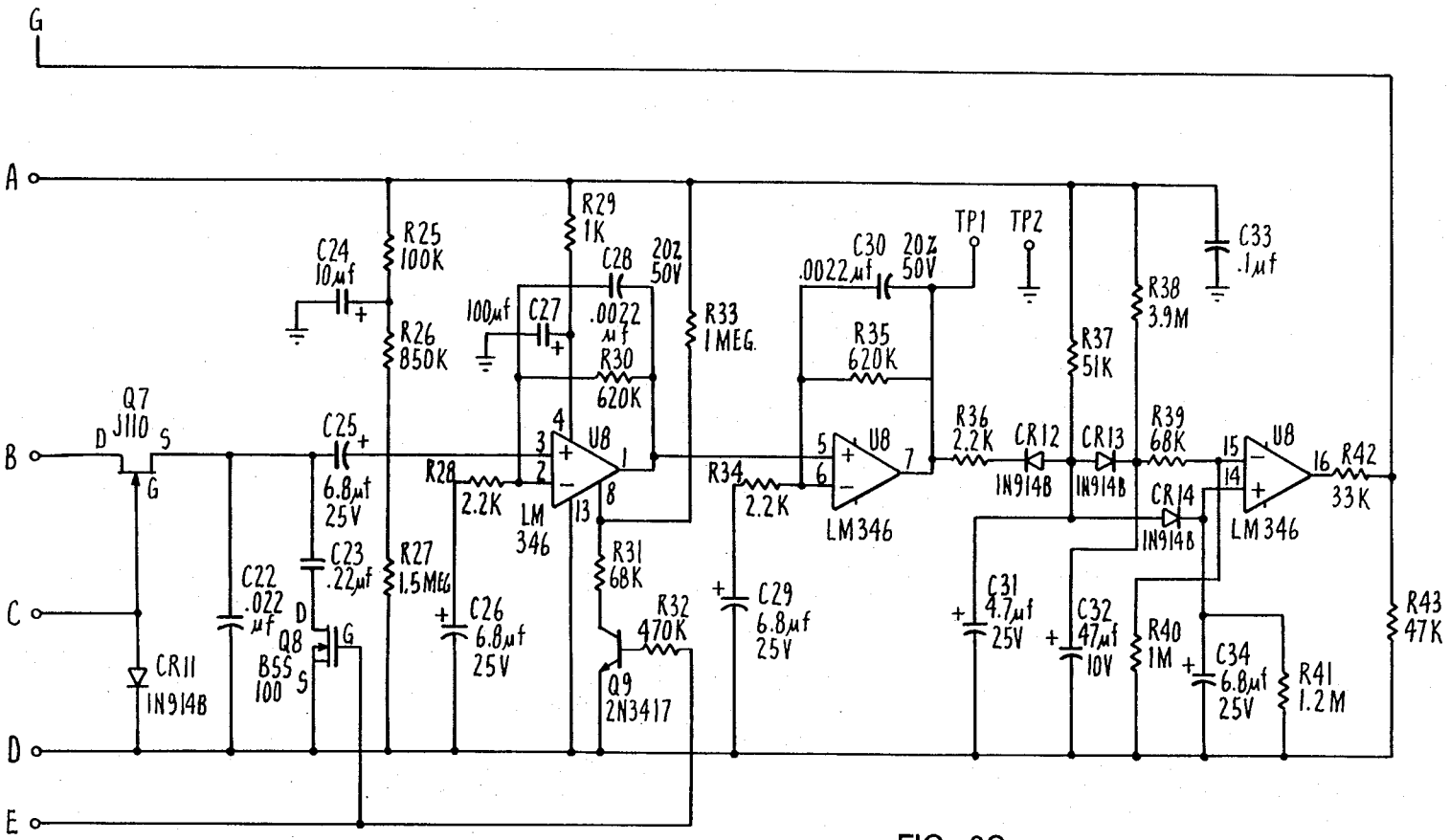

Referring to FIGS. 3A, 3B and 3C, there is shown in greater detail the circuit for the timer circuit 34, the alarm signal processing circuit 36, the mode select control circuit 38, the microwave detect circuit 40, the microwave drive circuit 42, and the microwave transceiver 44. The circuit diagrams shown in FIGS. 3B and 3C are connected at the points A, B, C, D, and E. The circuit diagram shown in FIG. 3B is connected to the circuit diagram shown in FIG. 3A at the point F. The circuit diagram shown in FIG. 3C is connected to the circuit diagram shown in FIG. 3A at the point G.

FIG. 3A shows the timer circuit and the alarm signal processing. U4 is a "one shot". When the PIR detect circuitry detects the presence of an intruder, pin 3 of the PIR connector goes low. This falling edge activates this first one shot. The output of this one shot stays low for five seconds. This is the time that the microwave transceiver drive is activated. Activation of this timer also begins the activation of the sample and hold, microwave amplifier circuitry, and the alarm signal processing. This is accomplished through signal F.

If detection occurs by the microwave sensing circuitry, the return signal is present on line G. U7 forms the AND gate of the PIR and the microwave signals. The output of U7 is then used to relay the alarm information to the control panel.

At the end of detection by the PIR detector, the other half of U4 then inhibits reactivation of the microwave detector for two minutes. If there are additional PIR detections during this time, the two minute period is restarted. In this fashion, in high traffic areas, the power consumption of the unit is kept to a minimum.

FIG. 3B shows the mode select logic and the microwave drive circuitry. When the microwave drive circuitry is activated, the voltage at F goes low. This turns on Q5. This then changes the feedback capacitance in the oscillator formed by R18 and C15 and C16. The two oscillating frequencies are the fundamental difference in the idle state and the active state of the microwave detection circuitry. In the idle state, the band width of the detect circuitry is not high enough to detect the presence of an intruder, however, all of the capacitors in the microwave amplifier and signal processing circuitry are charged up allowing for rapid detection when necessary. U7 then forms two pulses from the basic oscillator frequency. The first pulse is for the microwave drive transistor, Q6. The second pulse C is slightly delayed. This is used for the sample and hold transistor. The actual return doppler shifted signal is present on line B.

FIG. 3C also includes some of the select control circuitry, the sample and hold, the microwave amplifier, and the microwave alarm signal processing. Signal line E in this figure does two things, first it changes the sample and hold cap to one that will respond to the frequencies of interest, and secondly it takes the microwave amplifier out of the low current mode and into a more responsive mode (that also draws more current). The first two stages of U8 and the associated circuitry is the microwave amplifier, and CR12, CR13, and C30, C32 and the last stage of U8 along with associated resistors make up for the alarm signal processing. When an alarm is declared, the signal at G goes low (to a logic zero).

Figure 4:
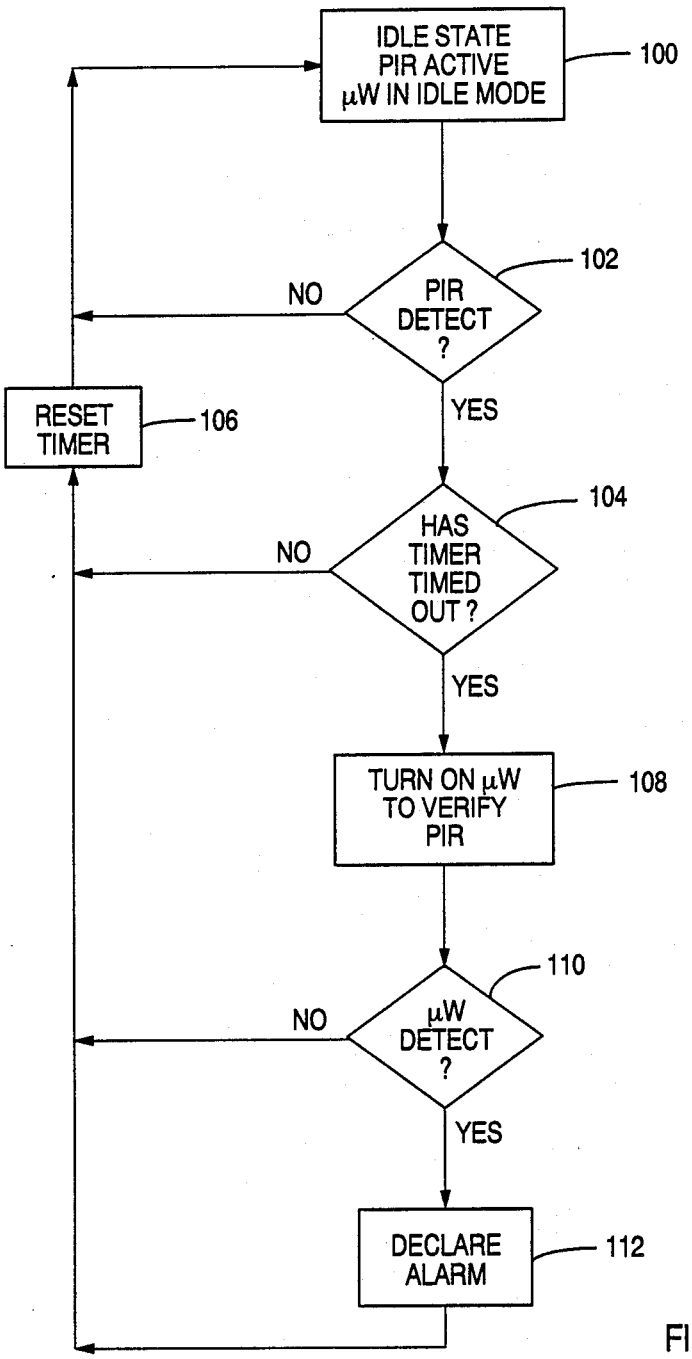
FIG. 4 is a flow chart diagram showing the operation of the intrusion detection system of FIG. 1.

The operation of the system 10 of the present invention can be understood by referring to the flow chart shown in FIG. 4. Initially, the microwave sensor/generator 44 is placed in an idle state. By an idle state, it is meant that the microwave sensor/generator 44 is supplied pulses at the rate of approximately 1 Hz. At approximately 1 Hz, the microwave sensor/generator 44 is unable to detect any intruder in the volume of space at which the microwave portion 6 is directed. However, at 1 Hz, all of the circuit elements in the microwave portion 6 are properly biased. Thus, although the microwave portion 6 is unable to detect the presence of an intruder, the microwave portion 6 is nevertheless in a state whereby it can be switched on rapidly.

In the absence of the microwave portion 6 being in an idle state, i.e., the microwave portion 6 were in a completely off state, it would take approximately two minutes for the microwave portion 6 to reach steady state whereby it is able to detect an intruder, from an off state. This is due to the capacitance and resistance in the system 10 and the frequency involved. The figure of 1 Hz rate is chosen because an intruder walking at 1 mile per hour will have the frequency rate of approximately 30 Hz. Thus, for the microwave portion 6 to detect an intruder operating at 1 Hz, the intruder must be moving less than 1/30th mile per hour (or is moving slower than .6 inch per second). In normal operation, i.e., active state when the microwave portion 6 is on, the microwave circuit portion is pulsed at the rate of 2 KHz.

Initially, the infrared radiation sensor portion 4 of the system 10 is on. However, since the infrared radiation sensor portion of the system 10 is a passive device, very little power is consumed by this device. Thus, initially, the only power consumed by the system 10 is the power to the electronics to process the infrared radiation detected and to maintain the microwave sensor portion 6 in the idle state. The infrared radiation sensing device 12 senses the presence of an intruder in the volume of space to which it is directed. This is shown as block 102. If an intruder is not detected, then system 10 reverts to the initial state 100. If an intruder is detected in that volume of space, the first signal 32 is produced.

The first signal 32, as previously stated, is provided to the timer circuit 34. The timer circuit 34 determines if the signal 32 is received within a preset period of time from when the last first signal 32 was received. If the current first signal 32 is received within the timing period of when the last first signal 32 is received, then the timing circuit is reset as shown by block 106 and the system 10 returns to the initial state 100.

On the other hand, if the timing circuit 34 has timed out, i.e., the present first signal 32 is received after the preset period of time from the last first signal 32 received, then the timing circuit 34 issues the control signal 35 to the mode select control circuit 38. The control signal 35 is sent to the mode select control circuit 38 to switch the microwave drive circuit 42 from an idle state to an active state and to turn the microwave detect circuit 40 from off to on. As previously discussed, by an active state it is meant that the microwave drive circuit 42 issues pulse signals to the microwave transceiver 44 at the rate of approximately 2 KHz.

Once the microwave drive circuit 42 is placed in an active state, and the microwave detect circuit 40 is placed in the on state, the microwave detect circuit 40 attempts to determine if an intruder is detected by the transceiver 44. If an intruder has not been detected by the microwave transceiver 44, then no second signal 46 is generated by the microwave detect circuit 40. In that event, the system 10 can reset the timer 34 and is returned to the idle state 100. On the other hand, if an intruder is detected by the microwave transceiver 44 and the second signal 46 is generated by the microwave detect circuit 40, then the alarm signal processing circuit 36 generates the alarm signal 50.

There are many advantages to the intrusion detection system 10 of the present invention. First and foremost is that power consumption is extremely low. Secondly, the immunity to false alarm of the dual sensor detection system is preserved. It should be noted that only idle power is supplied to the microwave intrusion sensor portion 6 of the detection system 10. The microwave intrusion sensor portion 6 is activated only when a passive infrared radiation detection portion 4 has detected an intruder and only when the detection of the intruder is after a preset period of time. The benefit of the latter will be explained hereinafter. Thus, the intrusion system 10 of the present invention can be used with a battery source and can be placed in any remote or inaccessible location. Furthermore, since power consumption is extremely low, on the order of 100 microamp, a rechargeable battery with a small solar collector can be used. The solar collector can be used to recharge the battery in the daytime in ambient light. The recharging of the rechargeable battery combined with the present invention virtually assures the detection system 10 having an indefinite lifetime. Alternatively, a nine volt battery would have an operational functional capability for lasting almost a year.

The timing circuit 34 of the system 10 provides yet another unique portion of the invention 10. During the daytime, for example, if the system 10 is directed in a normally people intensive place, such as a retail store, the system 10 should not be switched on at all. Thus, the timing circuit 34 provides that if one first signal 32 is detected followed by a second first signal 32 detected within the preset time period of the timing circuit 34, then the microwave sensor portion 6 is not turned on. This would indicate that there are many people milling about or being detected by the system 10 and is presumably normal activity and should not cause an alarm state. This further saves battery power drain.

Although the intrusion detection system 10 of the present invention has been described with respect to a passive infrared radiation detection sensor to trigger a microwave intrusion detection sensor, the invention can be practiced with any combination of dual sensors—provided that the first sensor, the sensor to initially detect the presence of an intruder is of the passive type. A passive intrusion detection sensor can be an infrared radiation detect sensor, such as that shown in FIG. 2 or it can also be an acoustic detection sensor which generates an output signal in response to an increase in acoustic energy in a volume of space. The second detection sensor can be an active or a passive detection sensor. An active detection sensor can be the microwave radiation detection sensor shown in FIG. 1, or it can be a photoelectric sensor, or even an ultrasonic detection sensor. The invention can be practiced by using any passive detection sensor to detect an intruder to generate an output signal, which turns on a second detection sensor. Further, the second detection sensor need not have an idle state and an active state—if a microwave detector is not used. If the active detection sensor is, for example, a photoelectric sensor, the sensor has an on state and an off state. This greatly reduces power and is immune to false alarms due to dual sensing nature of the system.

What is claimed is:

1. An intrusion detection system comprising a first passive detecting means for detecting the presence of an intruder in a volume of space and for generating a first signal in response to the detection of said intruder;

a second detecting means for detecting the presence of said intruder in said volume of space and for generating a second signal in response to the detection of said intruder;

a timing means for receiving said first signal and for generating a control signal after a period of delay in response to said first signal;

a signal switch means for receiving said control signal and for activating said second detecting means by supplying power thereto in response to said control signal; and logic means for receiving said first and said second signals and for producing an alarm signal in response thereto, said alarm signal indicative of the detection of the presence of said intruder in said volume of space.

2. The system of claim 1 wherein said timing means generates said control signal only if said first signal is received after said period of delay from the previous first signal received.

3. An intrusion detection system comprising a passive detecting means for detecting the presence of an intruder in a volume of space and for generating a first signal in response to the detection of said intruder;

a microwave detecting means having a ready state and an active state, for detecting the presence of said intruder in said volume of space and for generating a second signal in response to the detection of said intruder;

a means for maintaining said second detecting means in said ready state;

a switch means for activating said microwave detecting means by placing said microwave detecting means in said active state in response to said first signal; and logic means for receiving said first and said second signals and for producing an alarm signal in response thereto, said alarm signal indicative of the detection of the presence of said intruder in said volume of space.

4. The system of claim 3 wherein said switch means, in response to said first signal, supplies electrical power to said microwave detecting means to place it in said active state.

5. The system of claim 4 wherein said switch means further comprises a timing means for receiving said first signal and for generating a control signal after a period of delay in response to said first signal; and a signal switch means for receiving said control signal and for activating said microwave detecting means for supplying power thereto placing it in said active state.

6. The system of claim 3 wherein said passive detecting means is a passive infrared detector.

7. The system of claim 5 wherein said timing means generates said control signal only if said first signal is received after said period of delay from the previous first signal received.

8. A method of detecting an intruder in a volume of space comprising:

passively detecting said intruder by a first detecting means directed at said volume of space and generating a first signal in response thereto;

activating a second detecting means directed at said volume of space in response to said intruder detected by said first detecting means;

generating a second signal in response to said second detecting means detecting said intruder in said volume space; and processing said first and said second signals to produce an alarm signal, indicative of the presence of said intruder in said volume of space.

9. The method of claim 8 wherein said activating step comprises supplying electrical power to said second detecting means.

10. The method of claim 8 further comprising the steps of generating a control signal by a timing means in response to said first signal;

said control signal generated after a period of delay; and activating said second detecting means in response to said control signal.

11. The method of claim 10 further comprising the step of:

resetting said timing means in the event said first signal is received within said period of delay from the previous first signal received.

* * * * *